US005540332A

United States Patent [19]

Kopacz et al.

[11] Patent Number: 5,540,332

[45] Date of Patent: Jul. 30, 1996

[54] WET WIPES HAVING IMPROVED DISPENSABILITY

[75] Inventors: Thomas J. Kopacz, Omro; Teresa M. Zander, Appleton; Mark G. Everson, Neenah; Annamaria Cesco-Cancian, Appleton; Yvette L. Hammonds, Fond du Lac, all of Wis.

[73] Assignee: Kimberly-Clark Corporation, Neenah, Wis.

[21] Appl. No.: 418,737

[22] Filed: Apr. 7, 1995

[51] Int. Cl.[6] ..... A47K 10/24

[52] U.S. Cl. ..... 206/494; 221/48; 428/126; 428/192

[58] Field of Search ..... 428/121, 126, 428/195, 192; 221/48, 50, 47; 206/494

[56] References Cited

U.S. PATENT DOCUMENTS

| | | | |
|---|---|---|---|
| D. 185,661 | 7/1959 | Ellefson | D5/4 |
| D. 190,790 | 6/1961 | Ellefson | D87/3 |
| D. 315,990 | 4/1991 | Blenke et al. | D5/13 |
| D. 327,776 | 7/1992 | Hodges | D5/4 |
| 2,085,882 | 7/1937 | Wendel | 206/57 |
| 2,673,364 | 3/1954 | Diveley | 15/209 |
| 3,377,224 | 4/1968 | Gresham et al. | 156/209 |
| 3,380,580 | 4/1968 | Warp | 206/58 |
| 3,547,723 | 12/1970 | Gresham | 156/209 |
| 3,708,366 | 1/1973 | Donnelly | 156/209 |
| 4,100,324 | 7/1978 | Anderson et al. | 428/288 |
| 4,154,885 | 5/1979 | Tecl et al. | 428/198 |
| 4,183,995 | 1/1980 | Marshall | 428/284 |
| 4,350,246 | 9/1982 | Mayer | 206/210 |
| 4,443,513 | 4/1984 | Meitner et al. | 422/195 |
| 4,469,734 | 9/1984 | Minto et al. | 428/134 |
| 4,525,411 | 6/1985 | Schmidt | 428/198 |
| 4,612,226 | 9/1986 | Kennette et al. | 428/134 |
| 4,753,834 | 6/1988 | Braun et al. | 428/74 |
| 4,833,003 | 5/1989 | Win et al. | 428/198 |
| 4,853,281 | 8/1989 | Win et al. | 428/286 |
| 4,865,221 | 9/1989 | Jackson et al. | 221/48 |
| 5,030,500 | 7/1991 | Perdelwitz, Jr. et al. | 428/137 |
| 5,036,758 | 8/1991 | Kobayaski et al. | 101/28 |
| 5,069,735 | 12/1991 | Reynolds | 156/497 |
| 5,085,914 | 2/1992 | Perdelwitz, Jr. et al. | 428/137 |
| 5,295,579 | 3/1994 | Focke et al. | 206/494 |
| 5,332,118 | 7/1994 | Muckenfuhs | 221/48 |
| 5,368,188 | 11/1994 | Twardowski | 221/50 |

*Primary Examiner*—Alexander Thomas
*Attorney, Agent, or Firm*—Jeffrey B. Curtin

[57] ABSTRACT

A wet wipe having an improved dispensability and a method of producing the same are described. The wet wipe defines a pair of opposite end edges. At least a portion of one of the end edges is configured in a non-linear pattern which is adapted to facilitate a dispensing of the wet wipe. The end edge of the wet wipe which is configured in the non-linear pattern is further configured to provide a peel force of no more than 50 grams and a peel force ratio of at least 1.1. The wet wipe is also configured to provide an average dispensing force of no more than 10 grams and a dispensing force ratio of at least 1.1.

51 Claims, 6 Drawing Sheets

WET WIPES HAVING IMPROVED DISPENSABILITY

BACKGROUND OF THE INVENTION

1. Field of the Invention

The present invention relates to wet wipes which are typically arranged in a stacked configuration. The invention particularly concerns a wet wipe which has improved dispensability and a stack of the same.

2. Description of the Related Art

Wet wipes are well known commercial consumer products which have been available in many forms. Perhaps the most common form of wet wipes has been a stack of moistened sheets which have been packaged in a plastic container. Typically, the wet wipes have had straight or linear edges and a generally rectangular configuration. The wet wipes have also been available in either folded or unfolded configurations. For example, stacks of wet wipes have been available wherein each of the wet wipes in the stack have been arranged in a folded configuration such as a c-folded, z-folded or quarter-folded configuration as are well known to those skilled in the art. Each folded wet wipe has also been interfolded with the wet wipes immediately above and below in the stack of wet wipes. In addition, the wet wipes have been in the form of continuous webs of material which include perforations to separate the individual wet wipes and which are wound into rolls and packaged in plastic containers. Such wet wipes have been used for baby wipes, hand wipes, household cleaning wipes, industrial wipes and the like. The wet wipes have been made from a variety of materials and are moistened with a suitable wiping solution.

The conventional packages which contain stacks of wet wipes, such as those described above, have been designed to provide one at a time dispensing which can be accomplished using a single hand. Such single handed, one at a time dispensing is particularly desirable because the other hand of the user is typically required to be simultaneously used for other functions. For example, when changing a diaper product on an infant, the user typically uses one hand to hold and maintain the infant in a desired position while the other hand is searching for a wet wipe, such as a baby wipe, to clean the infant.

However, the dispensing of wet wipes in such stacks has not been completely satisfactory. For example, users of the wet wipes have had difficulties recognizing and grasping the edges of each individual wet wipe to dispense or remove the wet wipe from the package. This problem has been particularly acute when the individual wet wipes in the stack are folded such that the leading edge of each wet wipe is folded over upon another portion of the wet wipe. Typically, the user will frictionally drag from one to three fingers across the top surface of the stack of wet wipes in an attempt to peelingly lift the leading end edge of the top wet wipe from the stack of wet wipes. However, the leading end edge of each wet wipe in such a folded configuration has tended to have an affinity for the other portions of the wet wipe especially when the wet wipes have been arranged in a stacked configuration for a period of time. As a result, in use, it has been undesirably difficult for the user to peelingly lift the leading end edge of each wet wipe from the other portions of the wet wipe to facilitate the dispensing of each wet wipe from the stack of wet wipes.

Moreover, as each wet wipe in the stack of wet wipes has been dispensed or removed from the stack, the trailing edge portion of the wet wipe has not always easily separated from the adjacent wet wipe. Such difficult separation has undesirably caused the user to exert additional force to remove the wet wipe. In addition, in packages which contain a stack of individually folded wet wipes, each wet wipe has not always completely unfolded as it has been removed from the stack by the user. For example, the bottom flap portion of the individually folded wet wipe has undesirably remained in a contacting relationship with the other portions of the wet wipe as the wet wipe has been removed. Such difficult separation and incomplete unfolding has undesirably resulted in reduced consumer acceptance.

The difficulties encountered in dispensing the wet wipes has been particularly evident in stacks of wet wipes which have a greater amount of solution and in stacks of wet wipes which have a greater number of wet wipes. For example, each wet wipe and, in particular, the edges of each wet wipe have had an increased affinity for the other portions of the wet wipe and the adjacent wet wipe in the stack as the amount of solution in the stack increases. As a result, the consistency and reliability of the dispensing of such wet wipes has undesirably declined as the amount of solution has increased. Accordingly, it has been desired to provide a wet wipe and stack of wet wipes which have improved dispensability.

SUMMARY OF THE INVENTION

In response to the difficulties and problems discussed above, a new wet wipe and stack of wet wipes which have improved dispensability have been discovered.

In one aspect, the present invention relates to a wet wipe which defines a pair of opposite end edges. At least a portion of one of the end edges is configured in a non-linear pattern which is adapted to facilitate a dispensing of the wet wipe. In a particular aspect, the wet wipe contains from 150 to 600 weight percent of a liquid based on a dry weight of the wet wipe. The wet wipe may define a central portion and a top flap portion which is connected to and folded over upon the central portion along a first fold line. In such a configuration, the top flap portion includes the portion of the one end edge which is configured in the non-linear pattern. The portion of the one end edge of the wet wipe which is configured in the non-linear pattern may further be configured to provide a peel force of no more than 50 grams and a peel force ratio of at least 1.1 to facilitate the dispensing of the wet wipe. The portion of the one end edge of the wet wipe may also be configured to provide a dispensing force of no more than 10 grams.

In another aspect, the present invention relates to a stack of wet wipes which includes a plurality of wet wipes which are arranged in a stacked configuration. At least one of the wet wipes includes a pair of opposite end edges. At least a portion of one of the end edges is configured in a non-linear pattern which is adapted to facilitate the dispensing of the wet wipe from the stack of wet wipes. For example, the one end edge of the wet wipe may be configured in a sine wave pattern which defines a height from 1.5 to 3.0 millimeters and a repeat length from 2 to 20 millimeters. In a particular embodiment, the one end edge of the wet wipe is configured to provide a peel force of no more than 50 grams, a peel force ratio of at least 1.1 and a dispensing force ratio of at least 1.1.

In another aspect, the present invention relates to a stack of wet wipes which includes a liquid and a plurality of wet wipes which are individually folded and arranged in a stacked configuration. At least one of the wet wipes defines a leading end edge, a central portion and a top flap portion which includes the leading end edge. The top flap portion is connected to and folded over upon the central portion along a first fold line. At least a portion of the leading end edge is configured in a non-linear pattern which is adapted to be peelingly lifted by a user in use. The wet wipe may further include a bottom flap portion which includes a trailing end edge and which is connected to and folded under the central portion of the wet wipe along a second fold line. At least a portion of the trailing end edge of the wet wipe may also be configured in a non-linear pattern to facilitate the dispensing of the wet wipe. In a particular embodiment, the stack of wet wipes is disposed in the interior of a container, such as a plastic tub, which can be sealingly closed to provide a package of wet wipes which has improved dispensing.

In still another aspect of the invention, the present invention can provide a method for providing a stack of wet wipes which are easily dispensed. The method comprises the steps of: (a) providing a continuously moving web of material which includes a pair of opposite side edges wherein at least a section of one of the side edges is configured in a non-linear pattern; (b) folding the web of material along a first fold line to define a central portion and a top flap portion which includes the section of the one side edge and which is folded over upon the central portion; (c) selectively cutting the folded web of material to provide a plurality of generally rectangular, folded over wet wipes wherein the section of the one side edge of the web of material which is configured in the non-linear pattern provides at least a portion of an end edge of at least one of the wet wipes; and (d) arranging each of the folded over wet wipes in a stacked configuration to form the stack of wet wipes. The portion of the end edge of the at least one wet wipe which is configured in the non-linear pattern is adapted to be peelingly lifted by a user to facilitate a dispensing of the wet wipe from the stack of wet wipes. The non-linear pattern may be a sine wave pattern which defines a height from 1.5 to 3.0 millimeters and a repeat length from 2 to 20 millimeters.

The present invention, in its various aspects, advantageously relates to a wet wipe and stack of wet wipes which, when compared to conventional wet wipes and stacks of wet wipes, has more consistent and reliable dispensing. The wet wipe and stack of wet wipes of the present invention also provides wet wipes which have leading end edges which are easier to recognize and peelingly lift to facilitate the dispensing or removal of each wet wipe from the stack. Moreover, the present invention provides a folded over wet wipe and a stack of folded over wet wipes which have more reliable unfolding such that the user is better able to use only a single hand to remove and unfold the wet wipe for use.

BRIEF DESCRIPTION OF THE DRAWINGS

The present invention will be more fully understood and further advantages will become apparent when reference is made to the following detailed description of the invention and the accompanying drawings. The drawings are merely representative and are not intended to limit the scope of the claims.

DETAILED DESCRIPTION OF THE INVENTION

Figure 1:
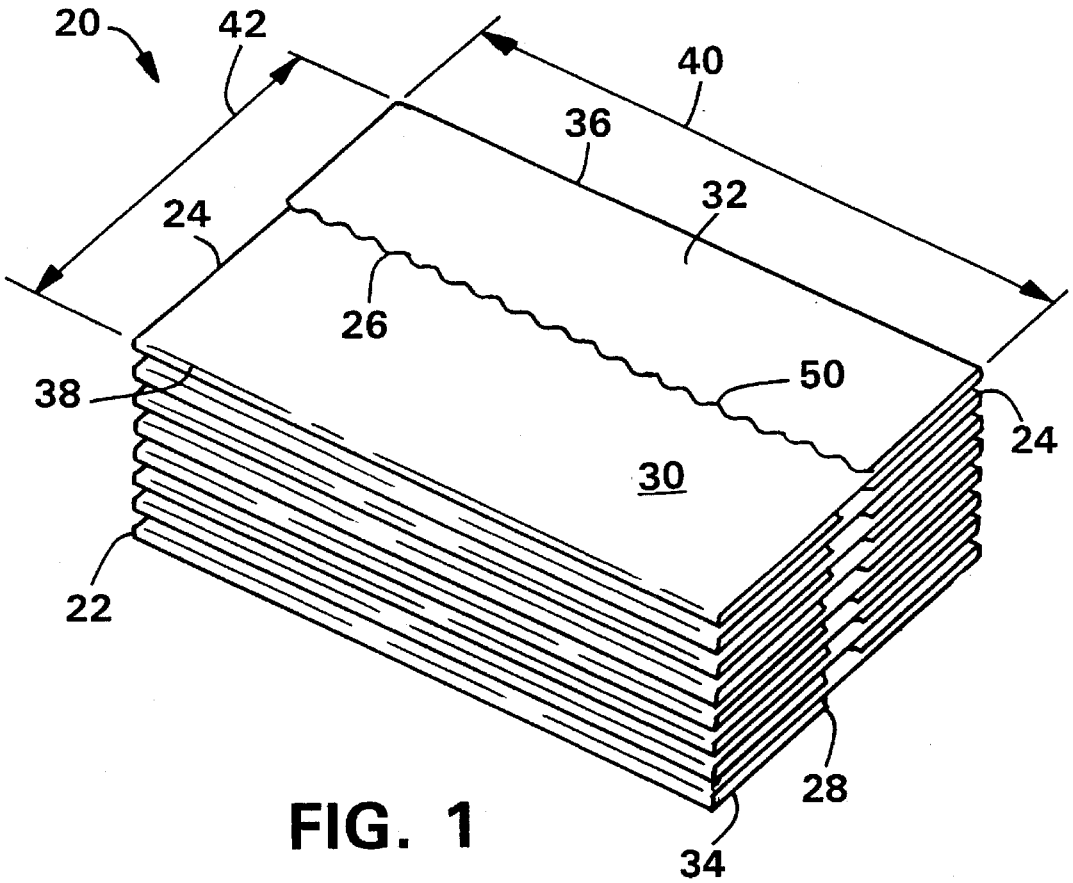
FIG. 1 representatively shows a perspective view of an example of a stack of wet wipes according to the present invention wherein each individual wet wipe is arranged in a z-folded configuration.

The present invention relates to a wet wipe and stack of wet wipes which have an improved dispensability and a method of making the same. In addition, the present invention provides a package which contains the stack of wet wipes. The wet wipe and stack of wet wipes of the present invention can be used for baby wipes, hand wipes, face wipes, cosmetic wipes, household wipes, industrial wipes and the like.

As used herein, the term "stack" and "stacked configuration" refers to any collection of wet wipes wherein there is a plurality of surface-to-surface interfaces between the wet wipes.

As used herein, the term "non-linear" refers to any edge of a sample wet wipe which has a standard deviation of at least about 150 microns, desirably at least about 200 microns and more desirably at least about 300 microns when tested according to the Non-Linear Test set forth in connection with the examples below. For example, the term "non-linear" may refer to an edge of a wet wipe which has a standard deviation of from about 150 to about 2000 microns, desirably from about 300 to about 1500 microns and more desirably from about 500 to about 1200 microns when tested according to the Non-Linear Test.

As representatively illustrated in FIGS. 1–4B, the present invention includes an individual wet wipe, as generally indicated at 22, which may be arranged in a stacked configuration to provide a stack of wet wipes 20. The stack of wet wipes 20 can comprise any suitable number of individual wet wipes 22. In a particular aspect, the stack of wet wipes 20 includes at least about 5 wet wipes and desirably from about 16 to about 320 wet wipes. Desirably, as representatively illustrated in FIG. 1, the stack of wet wipes 20 includes a plurality of wet wipes 22 which are arranged in a planar configuration and stacked vertically one on top of each other for improved dispensability.

The wet wipe 22 defines a pair of opposite side edges 24 and a pair of opposite end edges 26 and 28 which may be referred to as a leading end edge 26 and a trailing end edge 28. At least one of the end edges 26 and 28 of the wet wipe 22 is positioned to be grasped by a user to facilitate a dispensing of the wet wipe 22. Typically, the leading end edge 26 of the wet wipe 22, as representatively illustrated in FIGS. 1–4B, is grasped by the user in use. The individual wet wipe 22 may or may not be arranged in a folded configuration. Such folded configurations are well known to those skilled in the art and include, for example, c-folded, z-folded and quarter-folded configurations. For example, as representatively illustrated in FIGS. 1–4B, each individual wet wipe 22 may be arranged in a z-folded configuration. If the wet wipes 22 are folded, each wet wipe 22 may also be interfolded with the wet wipes immediately above and below in the stack of wet wipes 20.

When the wet wipe 22 is arranged in a folded configuration, such as the z-folded configuration representatively illustrated in FIGS. 1–4B, the wet wipe 22 may define a central portion 30 and a top flap portion 32. The top flap portion 32 is connected to the central portion 30 along a first fold line 36 and is folded over upon the central portion 30 before the wet wipe 22 is placed in the stack of wet wipes 20. Desirably, the top flap portion 32 is shorter in length than the central portion 30 such that it does not cover the entire central portion 30. The top flap portion 32 may include the end edge 26 of the wet wipe 22 which is adapted to facilitate the dispensing of the wet wipe 22 from the stack of wet wipes 20.

Figure 2:
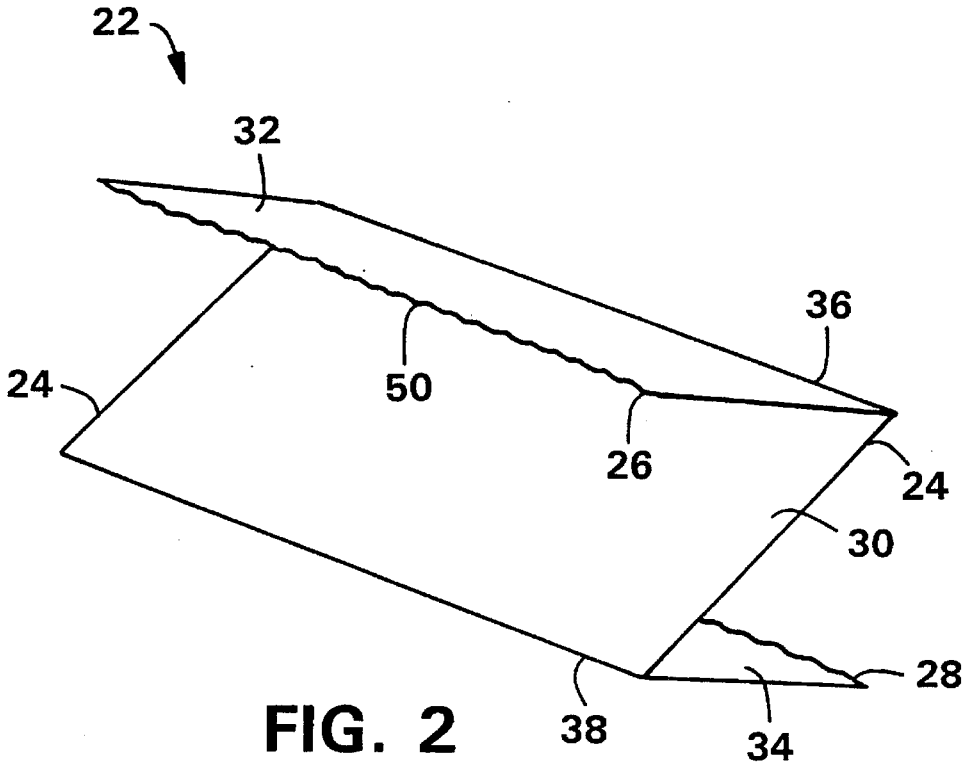
FIG. 2 representatively shows a partially unfolded perspective view of one of the wet wipes representatively illustrated in FIG. 1.

If the wet wipe 22 is arranged in a z-folded configuration as illustrated in FIGS. 1 and 2, the wet wipe 22 also defines a bottom flap portion 34. In such a configuration, the bottom flap portion 34 includes the opposite or trailing end edge 28 of the wet wipe 22. The bottom flap portion 34 is folded about a second fold line 38 under the central portion 30 of the wet wipe 22. The first and second fold lines 36 and 38 can be located on the wet wipe 22 in any position which provides the desired folding. For example, the first fold line 36 may be located from about 1.0 to about 8.0 centimeters and desirably from about 3.0 to about 6.0 centimeters from the leading end edge 26 of the wet wipe 22 and the second fold line 38 may be located from about 1.0 to about 8.0 and desirably from about 3.0 to about 6.0 centimeters from the trailing end edge 28 of the wet wipe 22 to provide the desired folding.

As representatively illustrated in FIG. 1, the stack of wet wipes 20 has a width 40 and a length 42. If the individual wet wipes 22 within the stack of wet wipes 20 are folded prior to being arranged in the stacked configuration, the width 40 and length 42 of the stack of wet wipes 20 refers to the as-folded width and length of the individual wet wipes 22. The stack of wet wipes 20 may have any suitable width 40 and length 42. For example, the stack of wet wipes 20 may have a width 40 of from about 2.0 to about 80.0 centimeters and desirably from about 10.0 to about 25.0 centimeters and a length 42 of from about 2.0 to about 40.0 centimeters and desirably from about 7.0 to about 14.0 centimeters.

Figure 3A:
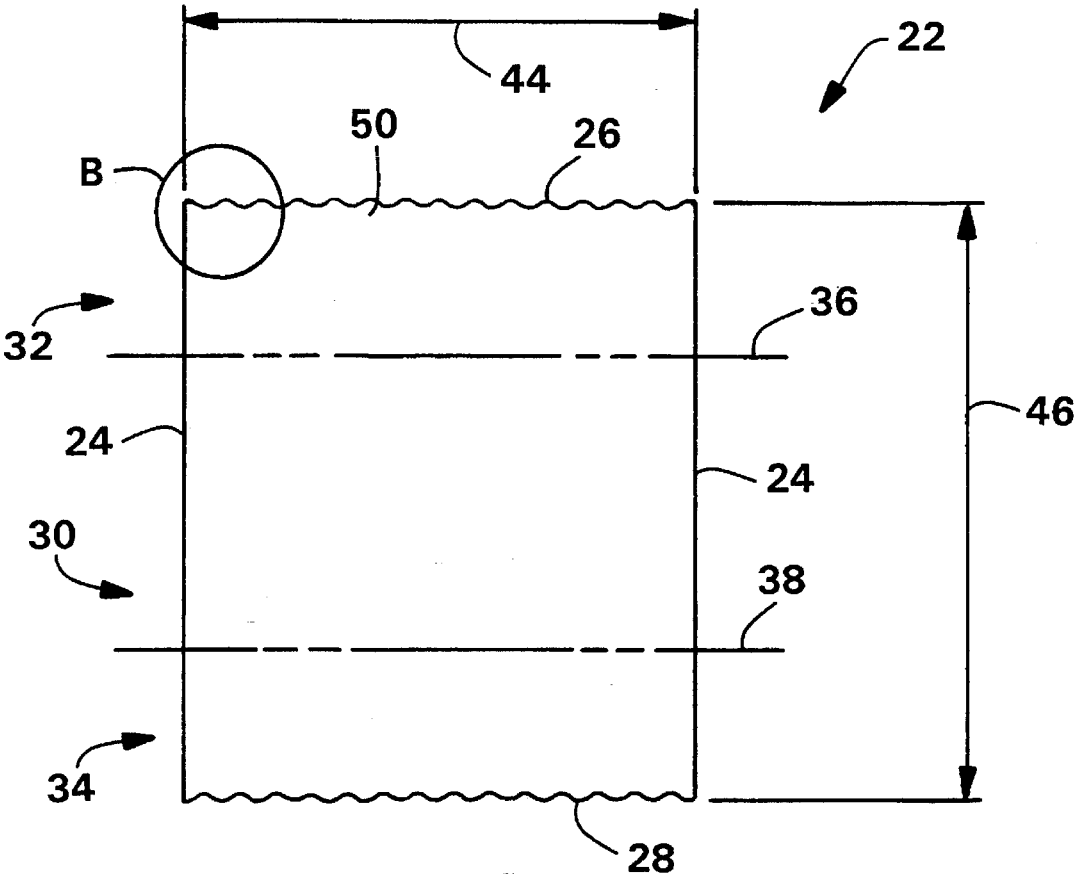
FIG. 3A representatively shows a top plan view of one of the wet wipes representatively illustrated in FIG. 1 which has been unfolded.
Figure 4A:
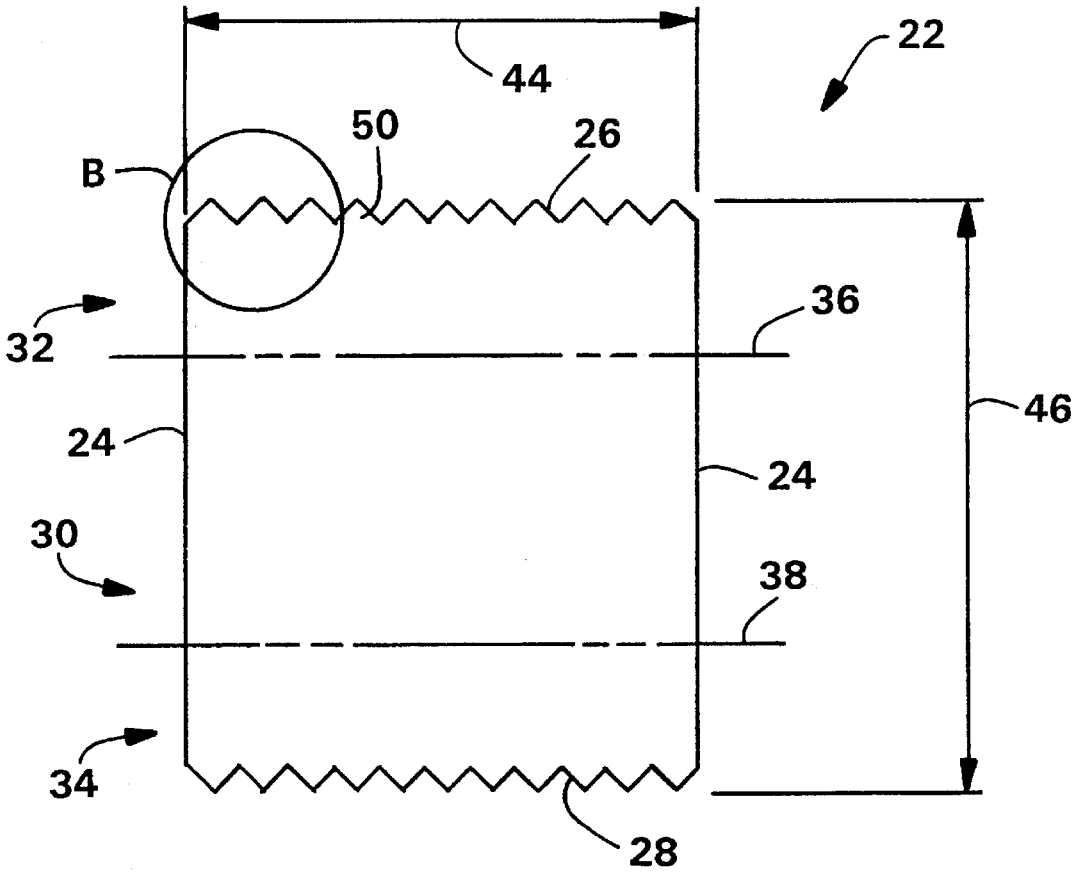
FIG. 4A representatively shows a top plan view of another example of an unfolded wet wipe according to the present invention.

As representatively illustrated in FIGS. 3A and 4A, the wet wipe 22 of the different aspects of the present invention is generally rectangular in shape. The wet wipe 22 defines an unfolded width 44 and an unfolded length 46. The wet wipe 22 may have any suitable unfolded width 44 and length 46. For example, the wet wipe 22 may have an unfolded width 44 of from about 2.0 to about 80.0 centimeters and desirably from about 10.0 to about 25.0 centimeters and an unfolded length 46 of from about 2.0 to about 80.0 centimeters and desirably from about 10.0 to about 45.0 centimeters. When the wet wipe 22 is folded about it's length and arranged in a stacked configuration as representatively illustrated in FIGS. 1 and 2, the width 40 of the stack of wet wipes 20 may correspond to the unfolded width 44 of the wet wipe 22 in the stack. One skilled in the art will recognize that if the wet wipe 22 is also folded about it's width, the width 40 of the stack of wet wipes 20 may not correspond to the unfolded width 44 of the wet wipe 22.

Materials suitable for the wet wipe 22 of the present invention are well known to those skilled in the art. The wet wipe 22 can be made from any material suitable for use as a moist wipe, including meltblown, coform, air-laid, bonded-carded web materials, hydroentangled materials and the like and can comprise synthetic or natural fibers or combinations thereof. The wet wipe 22 may have a basis weight of from about 25 to about 120 grams per square meter and desirably from about 40 to about 90 grams per square meter. In a particular aspect, the wet wipe 22 is a coform basesheet of polymeric microfibers and cellulosic fibers having a basis weight of from about 60 to about 80 grams per square meter and desirably about 75 grams per square meter. Such coform basesheets are manufactured generally as described in U.S. Pat. No. 4,100,324 to Anderson et al. which issued Jul. 11, 1978, and which is herein incorporated by reference.

Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet may comprise from about 20 to about 100 weight percent, desirably from about 20 to about 60 weight percent, and more desirably from about 30 to about 40 weight percent of polymeric microfibers based on the dry weight of the coform basesheet being used to provide the wet wipe. Alternatively, the wet wipe 22 can be made from a meltblown sheet of polymeric microfibers having a basis weight of from about 25 to about 120 grams per square meter.

The stack of wet wipes 20 and wet wipe 22 of the different aspects of the present invention contain a liquid which can be any solution which can be absorbed into the wet wipe 22. The liquid contained within the wet wipe 22 may include any suitable components which provide the desired wiping properties. For example, the components may include water, emollients, surfactants, preservatives, chelating agents, pH buffers or combinations thereof. The liquid may also contain lotions and/or medicaments. The amount of liquid contained within the wet wipe 22 may vary depending upon the type of material being used to provide the wet wipe 22, the type of liquid being used, the type of container being used to store the stack of wet wipes 20, and the desired end use of the wet wipe 22. Generally, each wet wipe 22 can contain from about 150 to about 600 weight percent and desirably from about 250 to about 450 weight percent liquid based on the dry weight of the wipe. In a particular aspect wherein the wet wipe 22 is made from a coform material comprising from about 30 to about 40 weight percent polymeric microfibers based on the dry weight of the wipe, the amount of liquid contained within the wet wipe 22 is from about 300 to about 400 weight percent and desirably about 330 weight percent based on the dry weight of the wet wipe 22.

Accordingly, the stack of wet wipes 20, as representatively illustrated in FIG. 1, may include from about 150 to about 600 weight percent, desirably from about 250 to about 450 weight percent, and more desirably from about 300 to about 400 weight percent of the liquid based on the dry weight of the stack of wet wipes 20. If the amount of liquid is less than the above-identified range, the wet wipe may be too dry and may not adequately perform. If the amount of liquid is greater than the above-identified range, the wet wipe may be oversaturated and soggy and the liquid may pool in the bottom of the container.

As representatively illustrated in FIGS. 1–4B, at least a portion of one of the end edges 26 and 28, such as the leading end edge 26, of the wet wipe 22 is configured in a non-linear pattern 50. The non-linear pattern 50 of the portion of the end edge of the wet wipe is adapted to facilitate a dispensing of the wet wipe 22. In a particular embodiment, at least a portion of both the leading end edge 26 and the trailing end edge 28 of the wet wipe 22 are configured in the non-linear pattern 50 to provide improved dispensing.

Applicants have discovered that, when compared to conventional wet wipes which have linear end edges, the non-linear pattern 50 of the portion of the leading end edge 26 of the wet wipe 22 of the present invention provides improved dispensing by allowing the user to easily recognize and peel back the leading end edge 26 of the wet wipe 22. Moreover, the non-linear pattern 50 of the end edges 26 and 28 provides improved dispensing by reducing the amount of force and energy required to dispense the wet wipe 22 and, in particular, the end edges 26 and 28 of the wet wipe 22. As a result, it is desirable that the entire leading end edge 26 and trailing end edge 28 of the wet wipe 22 are configured in the non-linear pattern 50 for improved performance.

The non-linear pattern 50 of the end edges 26 and 28 of the wet wipe 22 is particularly important as the amount of liquid in the wet wipe increases which tends to increase the affinity between the end edges 26 and 28 and the other portions of the wet wipe 22 and any adjacent wet wipes. For example, the non-linear pattern 50 provides particularly improved dispensing when the amount of liquid in the wet wipe 22 is greater than 150 weight percent based on the dry weight of the wet wipe 22. Moreover, the non-linear pattern 50 of the end edges 26 and 28 of the wet wipe 22 is also important as the number of wet wipes 22 in the stack of wet wipes increases. As the number of wet wipes 22 in the stack increases, the affinity between the end edges 26 and 28 and the other portions of the wet wipe 22 and adjacent wet wipes also increases due to the gravitational forces exerted on each wet wipe 22. For example, the non-linear pattern 50 provides particularly improved dispensing when the number of wet wipes 22 in the stack of wet wipes 20 is greater than 40.

The non-linear pattern 50 of the end edges 26 and 28 of the wet wipe 22 is also particularly important when the wet wipe 22 is arranged in a folded configuration. For example, as representatively illustrated in FIG. 1, the leading end edge 26 may be folded over and positioned in the central portion of the wet wipe 22. In such a folded configuration, the leading end edge 26 of the wet wipe 22 is not positioned along the side edges of the stack of wet wipes 20 for quick visual location and removal. Instead, the leading end edge 26 of the wet wipe 22 must be recognized and peelingly removed from the rest of the wet wipe 22 to facilitate the dispensing of the wet wipe 22. Moreover, when the wet wipe 22 is arranged in a folded configuration, the bottom flap portion and the trailing end edge 28 of the wet wipe 22 has an affinity for the rest of the wet wipe and may not properly unfold. The non-linear pattern 50 of the end edges 26 and 28 of the wet wipe 22 of the different aspects of the present invention is configured to provide improved dispensing and more reliable and complete unfolding of wet wipes which are arranged in such a folded configuration.

Applicants have discovered that, when compared to conventional wet wipes, the wet wipe 22 of the different aspects of the present invention can provide improved dispensing by providing a wet wipe 22 which requires a lower peel force to peelingly lift and peel back the leading end edge 26 of the wet wipe 22. As used herein, the term "peel force" refers to the peel force value as determined according to the Peel Force Test set forth below in connection with the examples. In a particular embodiment, the portion of the leading end edge 26 of the wet wipe 22 which is configured in the non-linear pattern 50 is further configured to provide a peel force of no more than about 50 grams, desirably no more than about 30 grams and more desirably no more than about 15 grams to provide the improved dispensing. For example, the portion of the leading end edge 26 of the wet wipe 22 which is configured in the non-linear pattern 50 may be configured to provide a peel force of from about 5 grams to about 50 grams and desirably from about 5 to about 15 grams.

Applicants hypothesize that the reduction in peel force in the wet wipe 22 and stack of wet wipes 20 of the present invention is due to the reduced amount of material along the outermost portions of the leading end edge 26 of the wet wipe 22. For example, when the user frictionally drags at least one of their fingers along the top of the stack of wet wipes 20 and across the leading end edge 26 of the top wet wipe 22, the non-linear pattern 50 of the portion of the leading end edge 26 provides a reduced amount of material which is initially required to be peeled back from the rest of the wet wipe 22 when compared to conventional wet wipes which have a leading end edge which is configured in a linear pattern.

The portion of the leading end edge 26 of the wet wipe 22 which is configured in the non-linear pattern 50 can also provide a peel force ratio of at least about 1.1, desirably at least about 1.2 and more desirably at least about 1.5. As used herein, the term "peel force ratio" refers to the ratio of the average peel force value for a linear end edge on the wet wipe to the average peel force value for the non-linear end edge on the wet wipe. The average peel force values are determined according to the Peel Force Test set forth below in connection with the examples. For example, the portion of the leading end edge 26 of the wet wipe 22 of the present invention may be configured to provide a peel force ratio of from about 1.1 to about 3.0 and desirably from about 1.2 to about 2.0.

Applicants have also discovered that, when compared to conventional wet wipes which have linear end edges, the wet wipe 22 of the different aspects of the present invention can also provide improved dispensing by providing a wet wipe 22 which requires a lower average dispensing force to dispense the end edges of the wet wipe 22. As used herein, the term "dispensing force" refers to the dispensing force value as determined according to the Dispensing Test set forth below in connection with the examples. For example, when the user dispenses the wet wipe 22, the non-linear pattern 50 of the portion of the leading end edge 26 provides a reduction in the average dispensing force which is required to remove the leading end edge 26 from the rest of the wet wipe 22 when compared to conventional wet wipes which have linear end edges. Moreover, the non-linear pattern 50 of the portion of the trailing end edge 28 provides a reduction in the average dispensing force which is required to unfold the trailing end edge 28 from the rest of the wet wipe 22 and remove the wet wipe 22 from the adjacent wet wipe when compared to conventional wet wipes which have linear end edges.

In a particular embodiment, the portion of the end edge 26 and 28 of the wet wipe 22 of the present invention which is configured in the non-linear pattern 50 can provide an average dispensing force of no more than about 10 grams, desirably no more than about 5 grams and more desirably no more than about 2 grams to provide the improved dispensing. For example, the at least one end edge of the wet wipe 22 may be configured to provide an average dispensing force of from about 0.1 to about 10 grams and desirably from about 0.1 to about 2 grams.

The portion of the end edge 26 and 28 of the wet wipe 22 of the present invention which is configured in the non-linear pattern 50 can also provide a dispensing force ratio of at least about 1.1, desirably at least about 1.5 and more desirably at least about 2.0 for improved dispensing. As used herein, the term "dispensing force ratio" refers to the ratio of the average dispensing force value for a linear end edge on the wet wipe to the average dispensing force value for the non-linear end edge on the wet wipe. The average dispensing force values are determined according to the Dispensing Test set forth below in connection with the examples. For example, the portion of the end edge of the wet wipe 22 of the present invention may be configured to provide a dispensing force ratio of from about 1.1 to about 5.0 and desirably from about 1.5 to about 5.0. In a particular embodiment, the average dispensing force required to unfold and dispense the end edges 26 and 28 of the wet wipe 22 of the present invention is from about 30 to about 95 percent and desirably from about 30 to about 60 percent of the average dispensing force required to unfold and dispense the linear end edges of conventional wet wipes.

The portion of the end edges 26 and 28 of the wet wipe 22 may be configured in any non-linear pattern 50 which provides the improved dispensing. Suitable non-linear patterns include sine wave, zig-zag, circular patterns and the like as are well known to those skilled in the art. As representatively illustrated in FIGS. 1–4B, the non-linear pattern 50 has a height 52 and a repeat length 54. In a particular embodiment, the height 52 of the non-linear pattern 50 is at least about 1.0 millimeters and desirably from about 1.0 to about 5.0 millimeters and the repeat length 54 is from about 2.0 to about 20.0 millimeters and desirably from about 5.0 to about 10.0 millimeters to provide the improved dispensing.

Figure 3B:
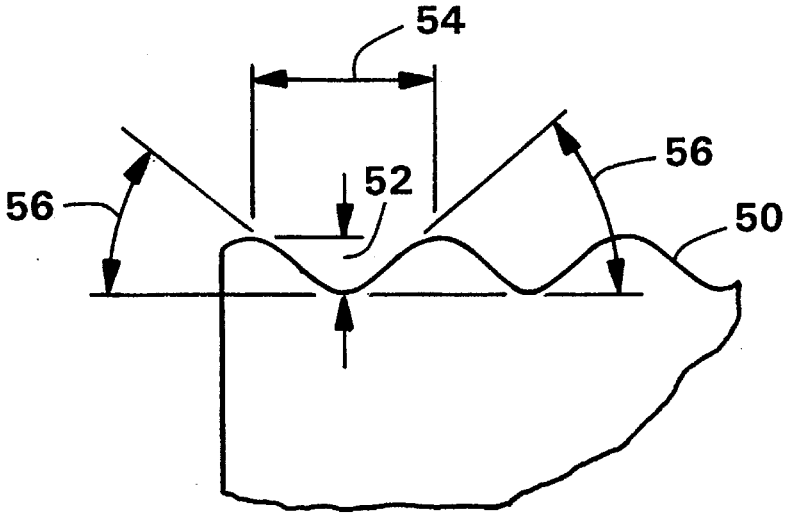
FIG. 3B representatively shows an expanded partial view of the end edge of the wet wipe representatively illustrated in FIG. 3A.

For example, as representatively illustrated in FIGS. 1–3B, the non-linear pattern 50 may be a sine wave pattern which has a height 52, a repeat length 54 and an included angle 56. The sine wave pattern 50 as illustrated in FIG. 3B desirably has a height 52 of at least about 1.0 millimeters and more desirably from about 1.5 to about 3.0 millimeters and a repeat length 54 of from about 2.0 to about 20.0 millimeters and desirably from about 5.5 to about 8.5 millimeters to provide the improved dispensing. The sine wave pattern 50 also has an included angle 56 of from about 10 to about 60 degrees and desirably from about 20 to about 45 degrees to facilitate the dispensing of the wet wipe.

Figure 4B:
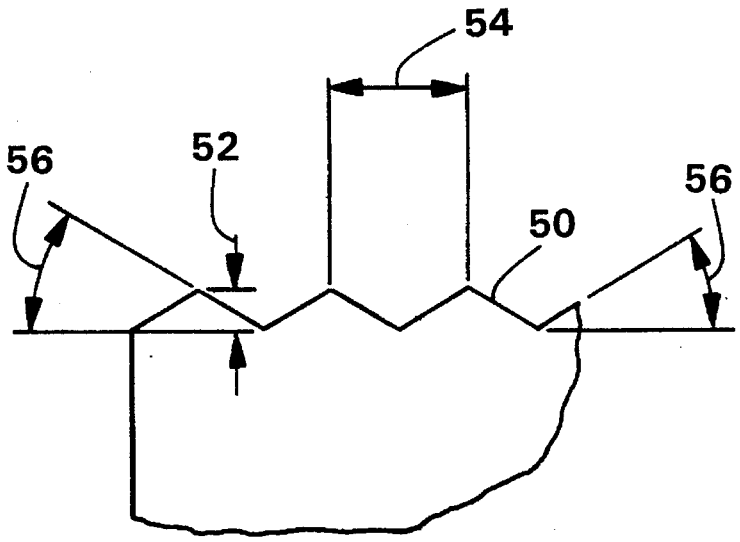
FIG. 4B representatively shows an expanded partial view of the end edge of the wet wipe representatively illustrated in FIG. 4A.

Alternatively, as representatively illustrated in FIGS. 4A and 4B, the non-linear pattern 50 may be a zig-zag pattern. The zig-zag pattern 50 desirably has a height 52 of at least about 1.0 millimeters and more desirably from about 1.5 to about 3.0 millimeters and a repeat length 54 of from about 5.5 to about 8.5 millimeters to provide the improved dispensing. The zig-zag pattern 50 also has an included angle 56 of from about 10 to about 60 degrees and desirably from about 20 to about 45 degrees to facilitate the dispensing of the wet wipe.

As representatively illustrated In FIGS. 1–4B, the stack of wet wipes 20 and wet wipe 22 of the different aspects of the present invention may be manufactured using several different processes well known to those skilled in the art. The particular method and sequence of steps described herein is not a limitation to the present invention, but is disclosed only as one method of producing a wet wipe and stack of wet wipes. Initially, a supply roll of the material being converted into the wet wipe 22 is unwound to provide a continuously moving web of material which has generally linear edges. The web of material is saturated or otherwise impregnated with a liquid, such as those described above, by any suitable means such as spraying, dipping, or the like as are well known to those skilled in the art. In a particular aspect, the web of material is passed over several perforated tubes which exude the liquid into the material. The add-on amount of liquid can be any amount which produces the desired wet wipe 22 and stack of wet wipes 20.

The web of material is slit in the machine direction into multiple ribbons, each of which may be folded into the type of fold desired for the individual wet wipe 22. The web of material is slit using a cutter which configures at least a portion of one of the edges of each of the multiple ribbons of material in a non-linear pattern 50, such as a sine wave pattern or zig-zag pattern as described above. For example, the web of material can be slit into eight ribbons which have edges configured in a sine wave pattern. The ribbons of material may then be folded into a folded configuration. For example, each ribbon of material may define a central portion and a top flap portion which is connected to and folded over upon the central portion along a first fold line. In such a configuration, the top flap portion includes the edge of the ribbon which is configured in the non-linear pattern. Each ribbon of material may also define a bottom flap portion which is connected to and folded under the central portion along a second fold line to provide a z-folded configuration.

Each folded ribbon may then be combined, one ribbon on top of the other, with the other seven folded ribbons from the same web of material to form a continuous "sausage." The sausage is then cut into "clips" of eight wet wipes apiece and the clips of wet wipes are arranged in a stacked configuration to form at least one stack of wet wipes 20, as representatively illustrated in FIG. 1. The number of clips in a stack depends on the desired number of stacks and the number of wet wipes 22 in the final package. For example, for an 80-count package having one stack, ten clips of eight wet wipes apiece would be required to form a single stack of 80 wet wipes.

After the stack of wet wipes 20, as representatively illustrated in FIG. 1, is properly configured, at least one stack of wet wipes 20 may be placed in the interior of a container, such as a plastic tub, to provide a package of wet wipes. As representatively illustrated in FIG. 5, the package of wet wipes, as generally indicated at 60, includes a container 62 which defines an interior 64 and which includes a reclosable top 66. The container 62 provides a substantially hermetically sealed environment for at least one stack of wet wipes 20 to minimize the escape of any liquid therefrom. The reclosable top 66 can be selectively opened and closed by the user to provide access to the stack of wet wipes 20.

At least one stack of wet wipes 20 of the different aspects of the present invention, as representatively illustrated in FIG. 1, is inserted into the interior 64 of the container 62 to provide the package of wet wipes 60. Any suitable number of wet wipes 22 may be included in the stack of wet wipes 20 to provide the desired number of wet wipes in the package 60. The interior 64 of the container 62 has a width 68 and a length 70 which are substantially equal to the width 40 and length 42 of the stack of wet wipes 20 as representatively illustrated in FIG. 1. When packaged in this configuration, it is difficult for the user to grasp each wet wipe 22 along it's side edges 24 or adjacent the fold lines 36 and 38 to facilitate a dispensing of each wet wipe 22 from the package of wet wipes 60. Accordingly, the user typically grasps the leading end edge 26 of each wet wipe 22 to dispense the wet wipe 22 from the container 62.

Figure 5:
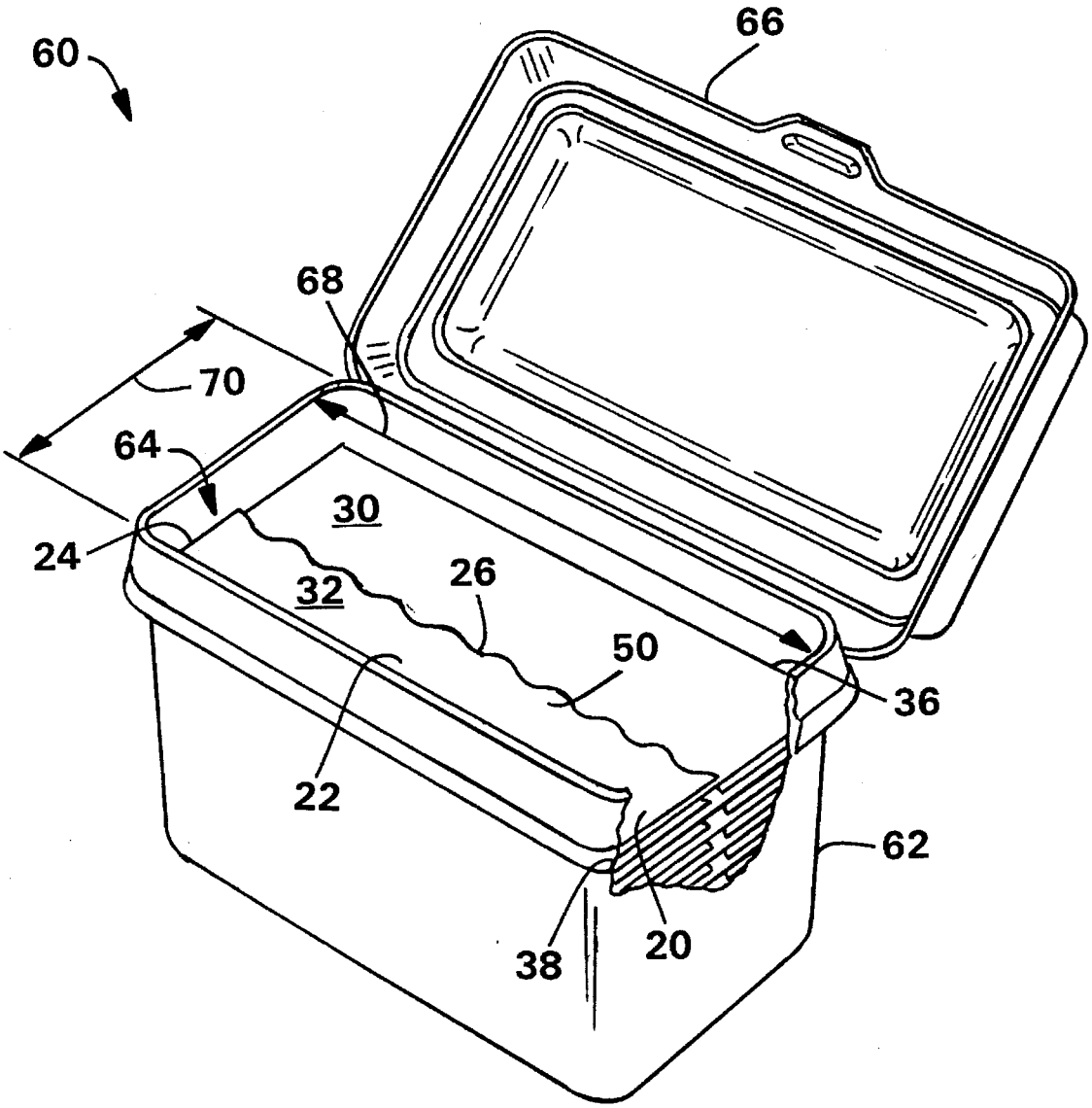
FIG. 5 representatively shows a partially cut away perspective view of an example of a package of wet wipes according to the present invention which contains a stack of wet wipes similar to the stack representatively illustrated in FIG. 1.

In use, the user can open the package of wet wipes 60, as representatively illustrated in FIG. 5, by lifting the reclosable top 66 of the container 62. After opening the reclosable top 66, the user can selectively drag one or more fingers across the top of the stack of wet wipes 20 to peelingly lift the leading end edge 26 of the top wet wipe 22 from the stack of wet wipes 20. Applicants have discovered that the configuration of the leading end edge 26 of the wet wipe 22 in a non-linear pattern 50 provides an improved dispensing of the wet wide 22 when compared to conventional wet wipes having linear edges. For example, the package of wet wipes 60 of the present invention can be opened and the wet wipe 22 can be easily dispensed with one hand. After dispensing one or more wet wipes 22, the user can close the reclosable top 66 to minimize the escape of any liquid. As long as the user maintains the reclosable top 66 in the closed position when not using the wet wipes 22, the wet wipes 22 should retain the desired amount of liquid.

Accordingly, the different aspects of the present invention can advantageously provide a wet wipe and stack of wet wipes which, when compared to conventional wet wipes and stacks of wet wipes, has improved dispensing of each wet wipe from the stack of wet wipes. Thus, the wet wipe, stack of wet wipes and method of the present invention provide wet wipes which are reliably and easily dispensed by one hand of the user to allow the user the freedom to use their other hand for other purposes. In particular, the wet wipe of the present invention provides a wet wipe which is configured to provide a peel force of no more than 50 grams and a peel force ratio of at least 1.1. The wet wipe of the present invention also provides an average dispensing force of no more than 10 grams and a dispensing force ratio of at least 1.1. Moreover, the present invention can provide a folded wet wipe which is configured to be consistently unfolded as it is dispensed. Such wet wipe and stack of wet wipes can advantageously be used for baby wipes, hand wipes, face wipes, cosmetic wipes, household wipes, industrial wipes and the like.

EXAMPLES

The following examples are presented to provide a more detailed understanding of the invention. The particular materials and parameters are exemplary and are not intended to limit the scope of the invention.

Non-Linear Test

This test procedure determines the non-linearity of an edge of a wet wipe. The test measures the standard deviation of multiple end points along the edge. The standard deviation is recorded in units of distance such as microns.

For the purposes of the present invention, a suitable technique for determining and measuring the standard deviation of the edge of a wet wipe involves taking a photomicrograph of the edge with a 50 mm El-Nikkor lens at an f/4 setting. The magnification for the photomicrograph is not critical but 1.7X is suitable for wet wipes according to the present invention.

The photomicrograph is placed on a macroviewer of an image analysis system, such as a Quantimet 970 series image analysis system distributed by Leica Instruments, Inc. of Deerfield, Ill. The end edge of the sample is divided into multiple line-bars having a width of about 337 microns and extending approximately perpendicular to the end edge. The standard deviation of the length of every other line-bar is then measured and recorded. For a stack of wet wipes, the test is repeated for nine other end edges of similar wet wipes and the average of the standard deviation values is recorded. As used herein, the term "average" refers to the sum of two or more measurements divided by the total number of measurements recorded.

Peel Force Test

This test procedure determines the load, measured in grams force, required to peel the leading end edge of a wet wipe from a stack of wet wipes. The force is measured in the direction in which the user would typically drag their fingers across the top of the stack of wet wipes to peel back the leading end edge of the top wet wipe. This direction is generally parallel to the top of the stack of wet wipes.

Equipment

1. Slip/peel tester capable of obtaining a peak load and equipped with an appropriate load cell. A suitable slip/peel tester is an Instrumentors Slip/Peel Tester with an MB-10 load cell, commercially available from Instrumentors, Inc., a business having offices located in Strongsville, Ohio, under the trade designation Model No. 3M90. The slip/peel tester is representatively illustrated in FIG. 6.
2. Linear Chart Recorder, which is commercially available from Linear Instruments, Corp., a business having offices located in Irvine, Calif., under the trade designation Model No. 1202.
3. #12 Rubber Finger Tip, which is commercially available from Swingline, Inc., a business having offices located in Long Island City, N.Y., under the trade designation Part No. 6102.
4. Aluminum load cell mounting bracket as described below and illustrated in FIGS. 6–7B at 104.
5. Aluminum stylus arm as described below and illustrated in FIGS. 6–7B at 106.
6. Aluminum sensor tip as described below and illustrated in FIGS. 6–7B at 108.

Figure 6:
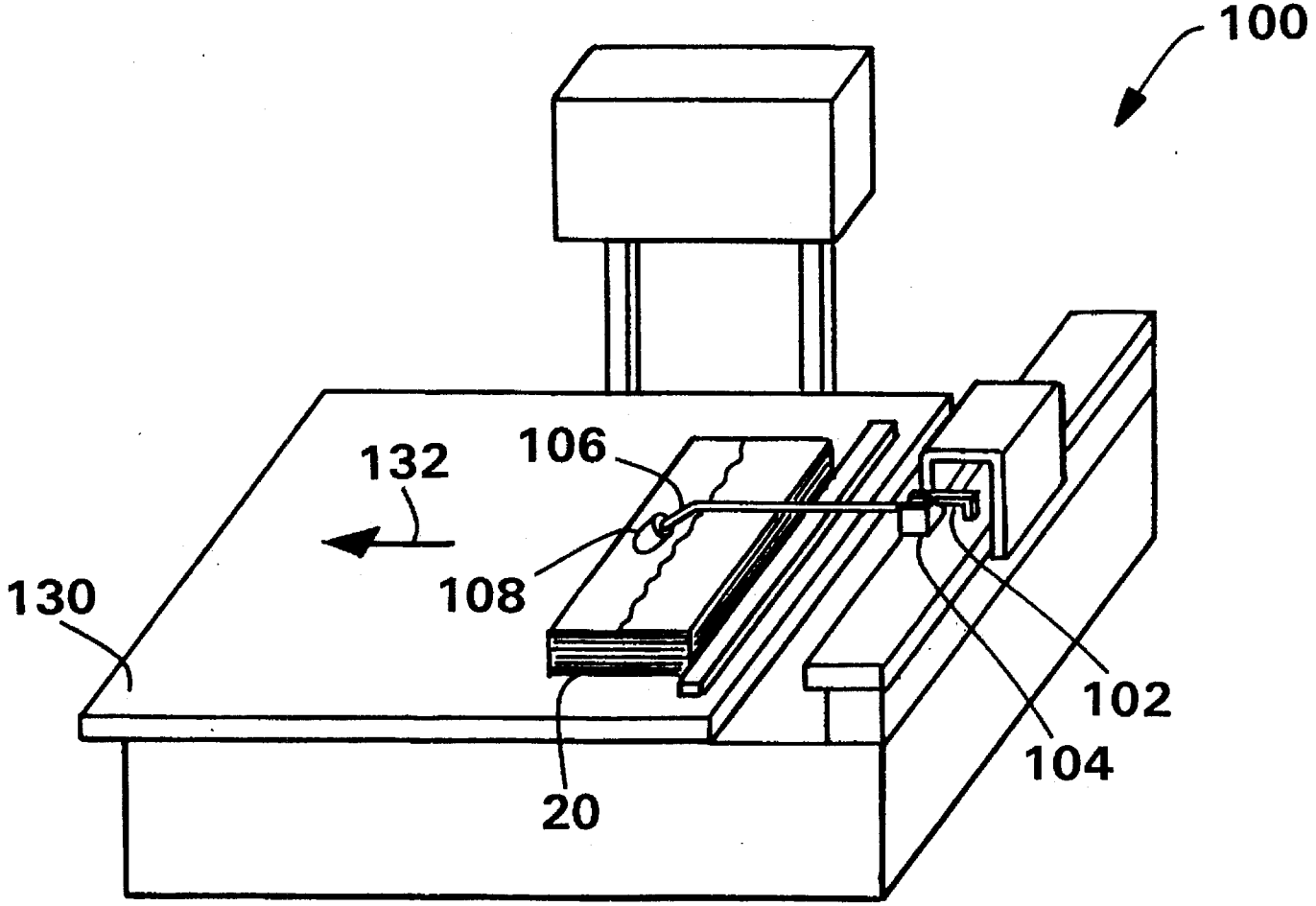
FIG. 6 representatively shows a perspective view of a testing apparatus used in the PEEL FORCE TEST according to the present invention.
Figure 7A:
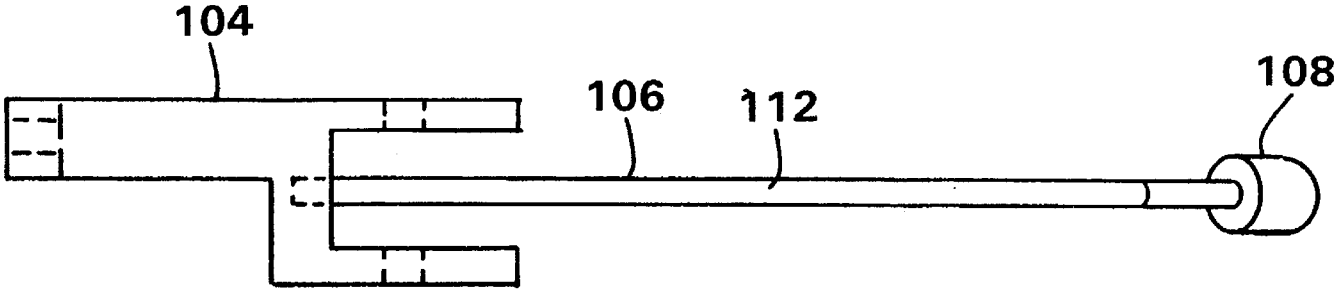
FIG. 7A representatively shows a top elevational view of a portion of the testing apparatus illustrated in FIG. 6.
Figure 7B:
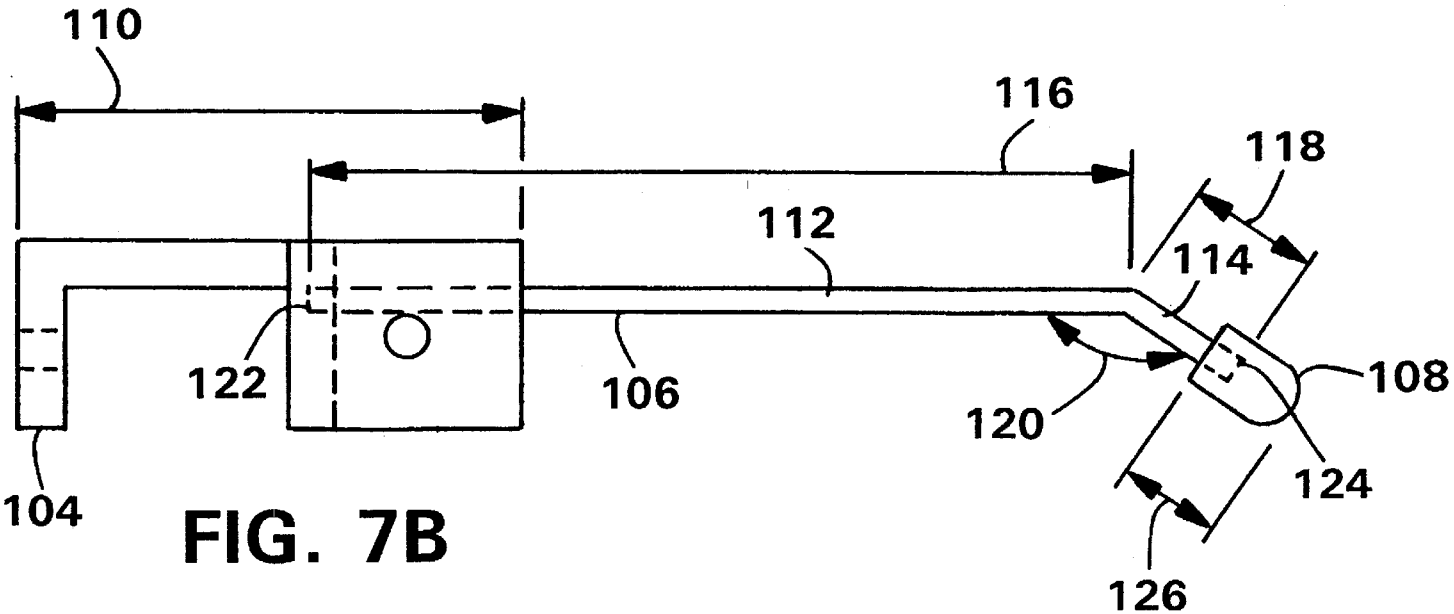
FIG. 7B representatively shows a side elevational view of the portion of the testing apparatus illustrated in FIG. 7A.

FIGS. 6–7B illustrate the configuration of the equipment used in the Peel Force Test. The equipment includes the slip/peel tester, generally indicated at 100, which includes the MB-10 load cell 102. The aluminum load cell mounting bracket 104 is connected to the load cell 102 on the slip/peel tester 100. The mounting bracket 104 has a length 110 of about 3.8 centimeters and is configured to connect to the stylus arm 106. The stylus arm 106 is made from an aluminum rod having a diameter of about 0.32 centimeters. The stylus arm 106 has a straight portion 112 and an angled portion 114. The straight portion 112 has a length 116 of about 12.1 centimeters and the angled portion 114 has a length 118 of about 2.5 centimeters. The angle 120 between the straight portion 112 and the angled portion 114 is about 135 degrees. One end 122 of the stylus arm 106 is threaded to connect to the mounting bracket 104 while the opposite end 124 of the stylus arm 106 is threaded to connect to the sensor tip 108. The sensor tip 108 is made from aluminum rod which has a diameter of about 1.4 centimeters and a length 126 of about 1.9 centimeters.

Sample Preparation

1. A plurality of wet wipes are individually removed from a package of wet wipes and rearranged in a z-folded, stacked configuration as representatively illustrated in FIGS. 1 and 2.
2. A lexan plate is placed on top of the stack of wet wipes. 4.5 kilograms of weights are placed on top of the lexan plate and allowed to remain on the plate for a period of 10 seconds. The lexan plate and the weights are then removed.

Test Procedure

1. The slip/peel tester is set up as representatively illustrated in FIG. 6. The slip/peel tester 100 includes the load cell 102 which is attached to the load cell mounting bracket 104. The stylus arm 106 is attached to the mounting bracket 104 and the sensor tip 108 is attached to the stylus arm 106.
2. The Swingline rubber finger tip is glued onto the sensor tip using rubber cement.
3. 78 grams of weight are placed on the stylus arm.
4. The stack of wet wipes 20 are positioned on the tester 100 as shown in FIG. 6.
5. The stylus arm and sensor tip are positioned on top of the stack of wet wipes.
6. The instrument settings for the slip/peel tester are set as follows:

Platen speed: 0.21 inches per second

Zero: B

Static/Kinetic: Static
7. The load cell is calibrated and the effect of the movement of the sensor tip across the smooth, non-edge surface of the wet wipe is tared out.
8. The platen 130 of the slip/peel tester is started in motion in the direction indicated by the arrow 132 associated therewith.
9. The peak and average load are measured and recorded as the leading end edge of the wet wipe is peeled back from the stack of wet wipes. The leading end edge of the wet wipe must be peeled back at least 0.25 inches to provide accurate results. Sample wet wipes which do not have a peel back of at least 0.25 inches are disregarded.

Dispensing Test

This test procedure determines the dispensing force, measured in grams force, required to dispense an end edge of a wet wipe from a stack of wet wipes. The wet wipe is dispensed in a vertical direction. This direction is generally perpendicular to the top of the stack of wet wipes.

Equipment

1. Tensile tester capable of obtaining a peak load and equipped with an appropriate load cell. A suitable tensile testing system is an Instron Model 4201 Tensile Tester, commercially available from Instron Corporation, Canton, Mass.
2. 90 pound per square inch grip commercially available from Instron Corporation, Canton, Mass., under the trade designation "Grips Instron 2712 (90 psi), Instron 2712-003."
3. 0.5 inch grip face, serrated, commercially available from Instron Corporation, Canton, Mass.

Sample Preparation

1. A stack of wet wipes, as representatively illustrated in FIGS. 1 and 2, are removed from a package of wet wipes.
2. A lexan plate is placed on top of the stack of wet wipes. Six kilograms of weight are placed on top of the lexan plate and allowed to remain on the plate for a period of 10 seconds. The lexan plate and the weights are then removed.

Test Procedure

1. The load cell is calibrated and the software loaded.
2. The grip is installed on the upper jaw of the tensile tester.
3. The test condition for the tensile tester are set as follows:

Crosshead speed: 500 millimeters/minute

Full-scale load: 2 kilograms

Gage length: 1 inch
4. The weight of the grip is tared out.
5. The top flap portion 32, as representatively illustrated in FIGS. 1 and 2, of the top wet wipe 22 is separated from the remainder of the wet wipe by cutting the wet wipe along fold line 36.
6. The cut edge of the wet wipe is inserted into the upper jaw such that the leading end edge and 0.5 inches of the wet wipe measured inwards from the leading end edge remains in contact with the central portion of the wet wipe.
7. The crosshead is started in motion.
8. The load is measured and recorded as the end edge of the wet wipe is dispensed from the stack of wet wipes.

Example 1

A coform basesheet having about 65 weight percent cellulosic fibers and 35 weight percent polypropylene microfibers based on the dry weight of the basesheet was provided. Liquid was added to the coform basesheet such that the basesheet had about 340 weight percent liquid based on the dry weight of the basesheet. The liquid was the same as that used in wet wipes which were commercially available under the trade designation Kleenex® Huggies® Baby Wipes from Kimberly-Clark Corporation, a business having offices located in Neenah, Wis. The liquid included water, emollients, surfactants, preservatives, pH buffers, chelating agents, or combinations thereof. The basesheet was selectively divided into a plurality of individual wet wipes having substantially linear end edges. The individual wet wipes 22 had an unfolded width 44 of 19.4 centimeters and an unfolded length 46 of 19.1 centimeters.

A sine wave pattern as representatively illustrated in FIGS. 3A and 3B was created on the end edges 26 and 28 of each wet wipe 22. The sine wave pattern 50 had a height 52 of 2.4 millimeters, a repeat length 54 of 8.5 millimeters and an included angle 56 of 42 degrees. The individual wet wipes 22 were z-folded and arranged in a stack of 80 wet wipes as representatively illustrated in FIG. 1. Each z-folded wet wipe 22 had a folded width 40 of 19.0 centimeters and a folded length 42 of 9.5 centimeters.

The non-linear leading end edges 26 of thirty-seven wet wipes 22 in the stack of wet wipes 20 were then subjected to the Peel Force Test as described above. The wet wipes had an average peel force of 12.9 grams.

Example 2

An 80-count stack of wet wipes having a sine wave pattern on their end edges was prepared as outlined in Example 1. The leading end edges 26 and trailing end edges 28 of five wet wipes 22 were then subjected to the Non-Linear lest as described above. The edges of the wet wipes had an average standard deviation of 942 microns.

Example 3

An 80-count stack of wet wipes having a sine wave pattern on their end edges was prepared as outlined in Example 1. Each wet wipe was manually removed from the stack of wet wipes. The number of wet wipes which did not unfold was recorded. The stack of wet wipes did not have any wet wipes which did not unfold.

Example 4

An 80-count stack of wet wipes having a sine wave pattern on their end edges was prepared as outlined in Example 1. The non-linear leading end edges 26 of twenty wet wipes 22 in the stack of wet wipes 20 were then subjected to the Dispensing Test as described above. The non-linear leading end edges of the wet wipes had an average dispensing force of 1.53 grams.

Example 5

An 80-count stack of wet wipes commercially available from Scott Paper Co., a business having offices located in Philadelphia, Pa., under the trade designation Baby Fresh With Natural Aloe was obtained. A sine wave pattern, as representatively illustrated in FIGS. 3A and 3B, was created on the end edges 26 and 28 of each wet wipe 22. The sine wave pattern 50 had a height 52 of 2.4 millimeters, a repeat length 54 of 8.5 millimeters and an included angle 56 of 42 degrees. The individual wet wipes 22 were z-folded and rearranged in a stack of 80 wet wipes as representatively illustrated in FIG. 1. The non-linear leading end edges of twenty wet wipes in the stack of wet wipes were then subjected to the Dispensing Test as described above. The wet wipes had an average dispensing force of 1.37 grams.

Comparative Example 1

An 80-count stack of wet wipes was prepared as outlined in Example 1 except that the end edges 26 and 28 of the wet wipes 22 were not altered and remained substantially linear. The leading end edges 26 of thirty-one wet wipes 22 in the stack of wet wipes 20 were then subjected to the Peel Force lest as described above. The linear end edges of the wet wipes had an average peel force of 19.8 grams.

The leading end edges 26 and trailing end edges 28 of five of the wet wipes 22 were also subjected to the Non-Linear Test described above. The linear edges of the wet wipes had an average standard deviation of 121 microns.

Comparative Example 2

An 80-count stack of wet wipes was prepared as outlined in Comparative Example 1 except that the end edges of the wet wipes were not altered and remained substantially linear. Each wet wipe was manually removed from the stack of wet wipes. The number of wet wipes which did not unfold was recorded. The stack of wet wipes having linear end edges had five wet wipes which did not unfold.

Comparative Example 3

An 80-count stack of wet wipes was prepared as outlined in Example 1 except that the end edges 26 and 28 of the wet wipes 22 were not altered and remained substantially linear. The leading end edges of twenty wet wipes 22 in the stack of wet wipes 20 were then subjected to the Dispensing Test as described above. The linear end edges of the wet wipes had an average dispensing force of 3.23 grams.

Comparative Example 4

An 80-count stack of wet wipes commercially available from Scott Paper Co., a business having offices located in Philadelphia, Pa., under the trade designation Baby Fresh With Natural Aloe was obtained. The end edges of the wet wipes were not altered and remained substantially linear. The wet wipes were arranged in a z-folded configuration similar to that representatively illustrated in FIG. 1. The leading end edges of twenty wet wipes in the stack of wet wipes were then subjected to the Dispensing Test as described above. The linear end edges of the wet wipes had an average dispensing force of 2.47 grams.

The leading end edges 26 and trailing end edges 28 of five of the wet wipes 22 were then subjected to the Non-Linear Test described above. The linear end edges of the wet wipes had an average standard deviation of 125 microns.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

What is claimed is:

1. A wet wipe comprising a pair of opposite end edges wherein at least a portion of one of said end edges is configured in a non-linear pattern which is adapted to facilitate a dispensing of said wet wipe wherein said non-linear pattern defines a repeat length of from about 2.0 to about 20.0 millimeters.

2. The wet wipe according to claim 1 wherein said wet wipe comprises a gas-formed matrix of thermoplastic polymeric meltblown microfibers and wood pulp fibers having a basis weight of from 25 to 120 grams per square meter.

3. The wet wipe according to claim 1 wherein said wet wipe contains from 150 to 600 weight percent of a liquid based on a dry weight of said wet wipe.

4. The wet wipe according to claim 1 wherein said wet wipe is further arranged in a folded configuration.

5. The wet wipe according to claim 4 wherein said wet wipe defines a central portion and a top flap portion which is connected to and folded over upon said central portion along a first fold line and wherein said top flap portion includes said portion of said one end edge which is configured in said non-linear pattern.

6. The wet wipe according to claim 1 wherein said portion of said one end edge of said wet wipe which is configured in said non-linear pattern is further configured to provide a peel force of no more than 50 grams to facilitate said dispensing of said wet wipe.

7. The wet wipe according to claim 1 wherein said portion of said one end edge of said wet wipe which is configured in said non-linear pattern is further configured to provide a peel force of from 5 to 50 grams to facilitate said dispensing of said wet wipe.

8. The wet wipe according to claim 1 wherein said portion of said one end edge of said wet wipe which is configured in said non-linear pattern is further configured to provide a peel force ratio of at least 1.1.

9. The wet wipe according to claim 1 wherein said portion of said one end edge of said wet wipe which is configured in said non-linear pattern is further configured to provide a dispensing force of no more than 10 grams to facilitate said dispensing of said wet wipe.

10. The wet wipe according to claim 1 wherein said wet wipe is configured to provide a dispensing force ratio of at least 1.1 to facilitate said dispensing of said wet wipe.

11. The wet wipe according to claim 1 wherein said non-linear pattern is a sine wave pattern.

12. The wet wipe according to claim 11 wherein said sine wave pattern defines a height of from 1.5 to 3.0 millimeters.

13. The wet wipe according to claim 1 wherein said non-linear pattern is a zig-zag pattern.

14. The wet wipe according to claim 1 wherein at least a portion of said end edge of said wet wipe opposite said one end edge is configured in a non-linear pattern.

15. The wet wipe according to claim 1 wherein said repeat length is from about 5.0 to about 10.0 millimeters.

16. The wet wipe according to claim 1 wherein said wet wipe defines a substantially rectangular configuration.

17. A stack of wet wipes comprising a plurality of wet wipes which are arranged in a stacked configuration wherein each of said wet wipes includes a pair of opposite end edges which are arranged in a nonoverlapping manner with said end edges of adjacent wet wipes in said stacked configuration and wherein at least a portion of one of said end edges is configured in a non-linear pattern which defines a repeat length of from about 2.0 to about 20.0 millimeters and which is adapted to facilitate a dispensing of said wet wipe from said stack of wet wipes.

18. The stack of wet wipes of claim 17 wherein said stack of wet wipes includes at least 40 wet wipes.

19. The stack of wet wipes according to claim 17 wherein said stack of wet wipes contains from 150 to 600 weight percent of a liquid based on a dry weight of said stack of wet wipes.

20. The stack of wet wipes according to claim 17 wherein said at least one wet wipe is further arranged in a folded configuration.

21. The stack of wet wipes according to claim 20 wherein said at least one wet wipe defines a central portion and a top flap portion which is connected to and folded over upon said central portion along a first fold line and wherein said top flap portion includes said portion of said one end edge of said at least one wet wipe which is configured in said non-linear pattern.

22. The stack of wet wipes according to claim 17 wherein said portion of said one end edge of said at least one wet wipe which is configured in said non-linear pattern is further configured to provide a peel force of no more than 50 grams to facilitate said dispensing of said at least one wet wipe.

23. The stack of wet wipes according to claim 17 wherein said portion of said one end edge of said at least one wet wipe which is configured in said non-linear pattern is further configured to provide a peel force of from 5 to 50 grams to facilitate said dispensing of said at least one wet wipe.

24. The stack of wet wipes according to claim 17 wherein said portion of said one end edge of said at least one wet wipe which is configured in said non-linear pattern is further configured to provide a peel force ratio of at least 1.1.

25. The stack of wet wipes according to claim 17 wherein said portion of said one end edge of said at least one wet wipe which is configured in said non-linear pattern is further configured to provide a dispensing force of no more than 10 grams to facilitate said dispensing of said at least one wet wipe.

26. The stack of wet wipes according to claim 17 wherein said at least one wet wipe is configured to provide a dispensing force ratio of at least 1.1 to facilitate said dispensing of said at least one wet wipe.

27. The stack of wet wipes according to claim 17 wherein said non-linear pattern is a sine wave pattern.

28. The stack of wet wipes according to claim 17 wherein at least a portion of said end edge of said at least one wet wipe which is opposite said one end edge is configured in a non-linear pattern.

29. The stack of wet wipes according to claim 27 wherein said sine wave pattern defines a height of from 1.5 to 3.0 millimeters.

30. The stack of wet wipes according to claim 17 wherein said non-linear pattern defines a repeat length of from about 5.0 to about 10.0 millimeters.

31. A stack of wet wipes comprising:

a) a liquid; and b) a plurality of wet wipes which are individually folded and arranged in a stacked configuration wherein at least one of said wet wipes defines:

i) a leading end edge;

ii) a central portion; and iii) a top flap portion which includes said leading end edge and which is connected to and folded over upon said central portion along a first fold line wherein at least a portion of said leading end edge is configured in a non-linear pattern which defines a repeat length of from about 2.0 to about 20.0 millimeters and which is adapted to be peelingly lifted by a user to facilitate a dispensing of said at least one wet wipe from said stack of wet wipes.

32. The stack of wet wipes according to claim 31 wherein said at least one wet wipe further defines a bottom flap portion which includes a trailing end edge and which is connected to and folded under said central portion along a second fold line.

33. The stack of wet wipes according to claim 32 wherein at least a portion of said trailing end edge of said at least one wet wipe is configured in a non-linear pattern to facilitate said dispensing of said at least one wet wipe.

34. The stack of wet wipes according to claim 31 wherein said portion of said leading end edge of said at least one wet wipe is configured in a sine wave pattern.

35. The stack of wet wipes according to claim 34 wherein said sine wave pattern defines a height from 1.5 to 3.0 millimeters.

36. The stack of wet wipes according to claim 31 wherein said portion of said leading end edge of said at least one wet wipe which is configured in said non-linear pattern is further configured to provide a peel force of no more than 50 grams.

37. The stack of wet wipes according to claim 31 wherein said portion of said leading end edge of said at least one wet wipe which is configured in said non-linear pattern is further configured to provide a peel force ratio of at least 1.1.

38. A package of wet wipes, comprising:

a) a container which defines an interior and is capable of being sealingly closed;

b) a stack of wet wipes which is disposed in said interior of said container, said stack of wet wipes comprising a plurality of wet wipes which contain a liquid and which are individually folded and arranged in a stacked configuration wherein at least one of said wet wipes defines:

i) a leading end edge;

ii) a central portion; and iii) a top flap portion which includes said leading end edge and which is connected to and folded over upon said central portion along a first fold line wherein at least a portion of said leading end edge is configured in a non-linear pattern which defines a repeat length of from about 2.0 millimeters to about 20.0 millimeters and which is adapted to be peelingly lifted by a user to facilitate a dispensing of said at least one wet wipe from said stack of wet wipes.

39. The package of wet wipes according to claim 38 wherein said portion of said leading end edge of said at least one wet wipe is configured in a sine wave pattern.

40. The package of wet wipes according to claim 38 wherein said portion of said leading end edge of said at least one wet wipe is configured to provide a peel force of no more than 50 grams to facilitate said dispensing of said at least one wet wipe.

41. The package of wet wipes according to claim 38 wherein said portion of said leading end edge of said at least one wet wipe is configured to provide a peel force ratio of at least 1.1 to facilitate said dispensing of said at least one wet wipe.

42. The package of wet wipes according to claim 38 wherein said portion of said leading end edge of said at least one wet wipe is configured to provide a dispensing force of no more than 10 grams to facilitate said dispensing of said at least one wet wipe.

43. The package of wet wipes according to claim 38 wherein said at least one wet wipe is configured to provide a dispensing force ratio of at least 1.1 to facilitate said dispensing of said at least one wet wipe.

44. The package of wet wipes according to claim 38 wherein said container comprises a plastic tub which includes a reclosable top.

45. The package of wet wipes according to claim 38 wherein said interior of said container includes a width which is substantially equal to a stack width of said stack of wet wipes and wherein said interior of said container includes a length which is substantially equal to a stack length of said stack of wet wipes.

46. A method for providing a stack of wet wipes which are easily dispensed, said method comprising the steps of:

a) providing a continuously moving web of material which includes a pair of opposite side edges wherein at least a section of one of said side edges of said web of material is configured in a non-linear pattern which defines a repeat length of from about 2.0 to about 20.0 millimeters;

b) folding said web of material along a first fold line to define a central portion and a top flap portion which includes said section of said one side edge and which is folded over upon said central portion;

c) selectively cutting said folded web of material to provide a plurality of generally rectangular, folded over wet wipes wherein said section of said one side edge of said web of material which is configured in said non-linear pattern provides at least a portion of an end edge of at least one of said wet wipes; and d) arranging each of said folded over wet wipes in a stacked configuration to form said stack of wet wipes wherein said portion of said end edge of said at least one wet wipe is arranged in a nonoverlapping manner with said end edges of adjacent wet wipes in said stacked configuration and is adapted to be peelingly lifted by a user to facilitate a dispensing of said at least one wet wipe from said stack of wet wipes.

47. The method according to claim 46 and further comprising the step of folding said web of material about a second fold line to define a bottom flap portion which is folded under said central portion.

48. The method according to claim 46 wherein at least a section of said side edge of said web of material opposite said one side edge is configured in a non-linear pattern.

49. The method according to claim 46 wherein said non-linear pattern is a sine wave pattern.

50. The method according to claim 49 wherein said sine wave pattern defines a height of from 1.5 to 3.0 millimeters.

51. The method according to claim 46 and further comprising the step of adding a liquid to said web of material before said step of folding said web of material.

* * * * *